US005236377A

United States Patent [19]

Goto

[11] Patent Number: 5,236,377

[45] Date of Patent: Aug. 17, 1993

[54] ELECTRICAL WIRE CONNECTOR

[75] Inventor: Kazuhiro Goto, Markham, Canada

[73] Assignee: AMP Incorporated, Harrisburg, Pa.

[21] Appl. No.: 860,940

[22] Filed: Mar. 31, 1992

[51] Int. Cl.[5] ..... H01R 4/32

[52] U.S. Cl. ..... 439/779; 411/954; 24/135 R

[58] Field of Search ..... 24/135 R; 411/924, 954; 403/389, 390, 391, 396; 439/778, 779, 780

[56] References Cited

U.S. PATENT DOCUMENTS

| | | | |
|---|---|---|---|
| 1,873,559 | 7/1931 | Dibner . | |
| 2,137,834 | 1/1936 | Dibner . | |
| 2,164,006 | 6/1939 | Dibner et al. . | |
| 2,180,931 | 6/1937 | Rogoff . | |
| 2,450,158 | 9/1944 | Pennell . | |
| 2,471,957 | 10/1945 | Hubbard . | |
| 2,547,663 | 9/1946 | Rogoff . | |
| 2,676,390 | 2/1951 | MacDonald . | |
| 2,770,818 | 5/1955 | Lee et al. . | |
| 2,885,776 | 6/1953 | Pellier | 29/417 |
| 3,174,385 | 3/1965 | Hallowell, Jr. . | |
| 3,298,072 | 12/1963 | Whalen . | |
| 4,147,446 | 5/1978 | Frank, Jr. | 403/390 |

OTHER PUBLICATIONS

Publication; "Burndy: Service Connectors".

*Primary Examiner*—Larry I. Schwartz
*Assistant Examiner*—Khiem Nguyen
*Attorney, Agent, or Firm*—Bruce J. Wolstoncroft

[57] ABSTRACT

An electrical wire connector of the type having a bifurcate bolt has a base member and two opposed prongs. The prongs are spaced apart to define a wire receiving channel therebetween. A nut is threadable onto the bolt about the prongs, the nut cooperates with a slide to engage a first respective wire and to urge the wire and other wires into electrical engagement with each other. The bolt has resilient portions which supply a force which acts upon the wires. The force supplied by the resilient portions is of sufficient magnitude to ensure that the wires will be maintained in electrical engagement even when the split bolt is exposed to harsh environments.

17 Claims, 4 Drawing Sheets

ELECTRICAL WIRE CONNECTOR

FIELD OF THE INVENTION

The present invention relates to electrical connectors for placing conductive wires in electrical engagement with each other.

BACKGROUND OF THE INVENTION

There are a variety of electrical connectors which electrically interconnect an uninsulated tap conductor wire to an uninsulated main conductor wire at a field site remote from a factory environment and using manual or portable power tools. One conventional type generally comprises a bolt which is split into two prongs extending upwardly from the bolt end. The prongs define a wire-receiving channel in which the main wire and an end portion of the tap wire are disposed. A nut is torqued onto the bifurcate bolt using conventional manual (or automatic) tools until a portion of the nut or an insert trapped in the bolt and nut assembly is pressed against a top one of the wires and urges the top wire against the bottom wire and the end of the bolt. One such connector is sold by Burndy Corporation, Norwalk, Connecticut under the trade name SERVIT Service Connectors. Such connectors are also disclosed in U.S. Pat. Nos. 1,873,559, 2,137,834, 2,164,006, 2,180,931, and 2,450,158.

These type of connectors are generally effective when the original termination occurs. However, after time the nut has a tendency to loosed, thereby allowing the wires to move away from each other resulting in an ineffective electrical connection. this problem is accelerated when the connector is exposed to harsh environments such as heat or vibration. It would, therefore, be beneficial to provide an electrical connector in which the nut is prevented from movement away from the wires.

SUMMARY OF THE INVENTION

The invention is directed to an electrical wire connector of the type having a bifurcate bolt with two opposed prongs. The prongs are spaced apart to define a wire receiving channel therebetween. A nut is threadable onto the bolt about the prongs to engage a first respective wire and to urge the wire and other wires into electrical engagement with each other Resilient portions extend from the prongs of the bolt to a bottom portion thereof. The resilient portions cooperate with the prongs to supply a force to the nut, when the nut is threaded onto the prongs. The force supplied by the resilient portions is of sufficient magnitude to prevent the nut from moving away from a first respective wire after the electrical engagement of the wires has been completed. The resilient portions have an arcuate configuration to increase the resiliency thereof.

The force applied to the nut causes an increased frictional component between the prongs and the nut. The force also has a downward component, which helps to maintain the nut in position relative to the wires. Consequently, the force supplied by the arcuate resilient portions acts on the nut to ensure that the nut will not be moved away from the wires, even when exposed to harsh environments. The resiliency of the arcuate portions, therefore, provides a much more effective electrical connection.

DETAILED DESCRIPTION OF THE INVENTION

Figure 1:
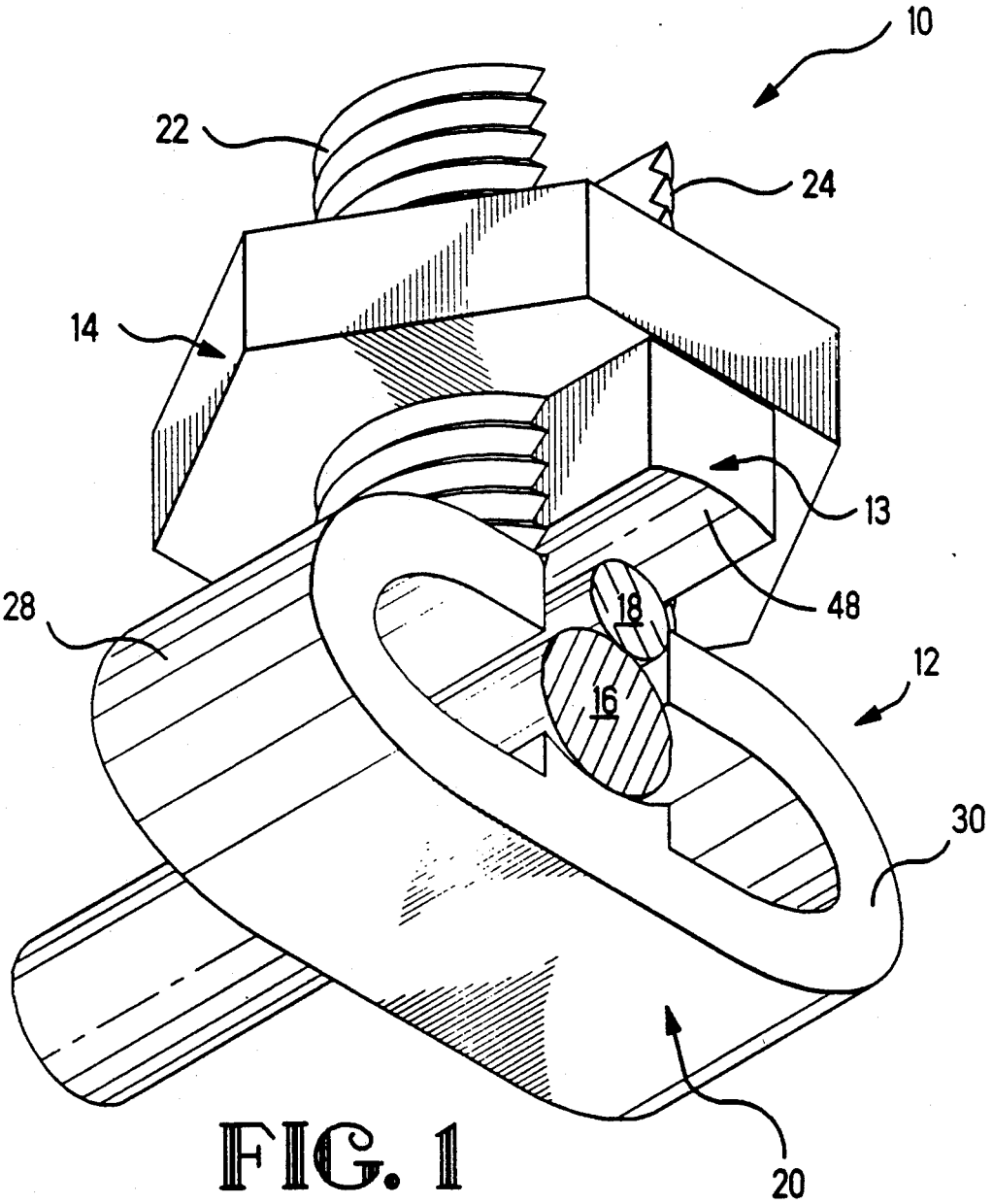
FIG. 1 is an isometric view of a connector of the present invention with wires terminated thereto.

Referring to FIG. 1, an electrical connector 10 includes a bifurcate or split bolt 12, a slide 13 and a nut 14 which are configured to establish and maintain an electrical engagement between at least two conductive wires 16, 18.

Figure 2:
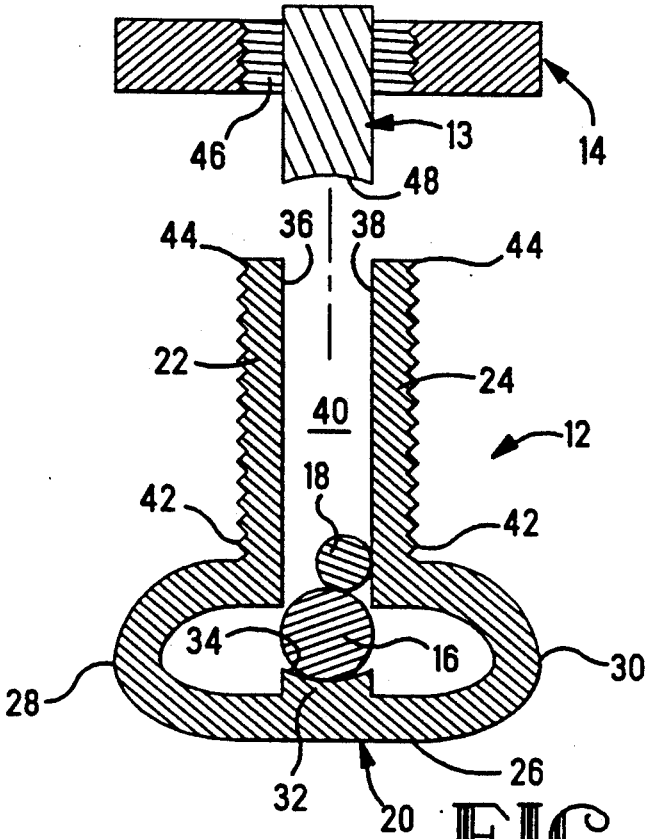
FIG. 2 is an elevational cross-sectional view of the connector prior to the nut being installed onto the bolt.
Figure 3:
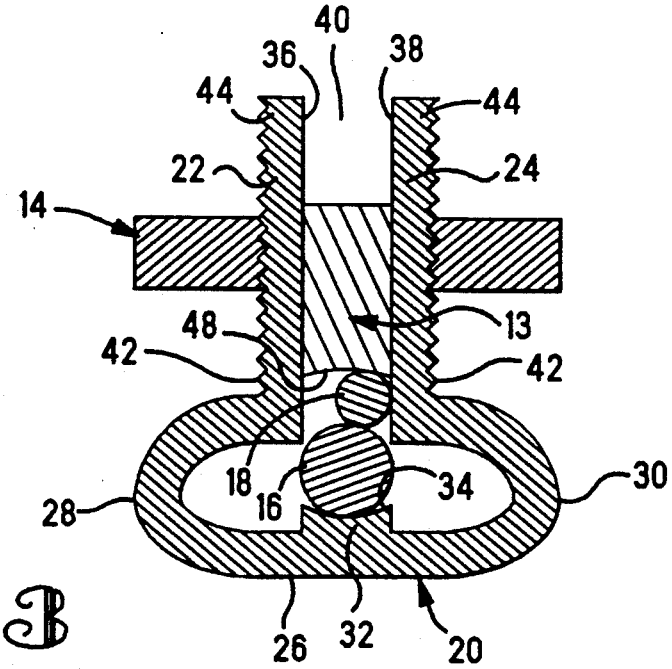
FIG. 3 is an elevational cross-sectional view, similar to that of FIG. 2, showing the connector with the nut inserted on the bolt and the wires terminated thereto.

Split bolt 12 may be formed from a flat blank of copper alloy, such as high-silicon bronze C65500. The bolt includes a resilient member or base member 20 and a pair of prongs 22, 24. Referring to FIGS. 2 and 3, the base member 20 has a transverse bottom portion or engagement portion 26 with arcuate resilient portions 28, 30 provided at either end thereof. The transverse bottom portion has an enlarged section 32 which extends from the bottom portion in a direction toward prongs 22, 24. A free end 34 of the enlarged section 32 has an arcuate configuration which forms a wire receiving recess.

Arcuate resilient portions 28, 30 extend from, and are integrally attached to, the bottom portion 26 and respective prongs 22, 24. Arcuate resilient portion 28 is essentially a mirror image of arcuate resilient portion 30. The arcuate resilient portions 28, 30 are generally C-shaped and are configured to be of sufficient length to allow the arcuate portions to be elastically deformed as the nut is applied to the prongs, as will be more fully discussed below. In other words, the arcuate configuration of portions 28, 30 allow the length of the portions to be greater than the distance between the bottom portions 26 and the prongs 22, 24. This increased length of the arcuate resilient portions 28, 30 enhances the resilient characteristics of the portions and allows the portions to deform a greater distance without taking a permanent set.

Prongs 22, 24 have respective opposed surfaces 36, 38 which form a portion of a wire receiving channel 40. The wire receiving channel extends to the free end 34 of the enlarged section of the bottom portion 26. Each prong 22, 24 has threads provided on the outer surface thereof. The threads are configured to cooperate with threads provided on nut 14. Prong 22 and prong 24 are essentially mirror images of each other. Therefore, for ease of further explanation and understanding, the same reference numbers will be used for both prongs.

The nut 14, in the particular embodiment shown, is of a standard construction. An opening 46 with threads positioned about the circumference is positioned in the center of the nut. The opening 46 is dimensioned to receive the prongs 22, 24 therein.

The slide 13 is dimensioned to be received in the opening 46 of nut 14. A bottom surface 48 has an arcuate configuration.

In operation, wires 16, 18 are positioned in the wire receiving channel 40, as shown in FIG. 2. Wire 16 cooperates with the arcuate free end 34 of enlarged section 32. Corners of the arcuate portions 28, 30 are positioned to engage wire 16 if the wire is moved toward either opposing surface 36, 38. Consequently, the wire 16 is maintained within the wire receiving channel 40 by the arcuate free end 34 and the corners of arcuate portions 28, 30.

With wire 16 properly positioned, wire 18 is positioned in the wire receiving channel 40. Wire 18 is moved toward base member 20, but is prevented from movement past wire 16. As is evident from FIG. 2, the wire receiving channel 40 is dimensioned such that the wire 18 cannot be moved between wire 16 and opposed surfaces 36, 38.

After the wires are positioned in the channel 40, the nut 14 and slide 13 are moved into engagement with the prongs 22, 24. Once the nut 14 has been positioned on the prongs 22, 24, the nut is rotated or tightened until the bottom surface 48 of the slide 13 is urged into tight engagement with upper wire 18, causing the wires 16, 18 to be trapped between the slide 13 and enlarged section 32.

It is important to note that although the prior art nuts were provided in tight engagement when the termination was originally completed, the nuts would become loose over time, allowing the wires to move away from each other thereby causing the electrical connection to be ineffective. This was particularly evident in environments in which elevated temperatures and vibration was present.

The configuration of the present invention greatly reduces the possibility of the nut becoming loose, even in severe environments. As the nut is tightened, the wires are forced toward the bottom portion 26. This causes the bottom portion to deform downward, away from the prongs 22, 24. As the bottom portions 26 is integrally attached to the arcuate resilient portions 28, 30, the deformation of the bottom portion 26 will cause the resilient portions 28, 30 to move to a stressed position. In this stressed position, the resilient portions 28, 30 will exert a force on the bottom portion 26. This force will cause the bottom portion 26 to resist the downward movement thereof. Consequently, if the nut is caused to move upward, away from wires 16, 18, the resilient force will cause the bottom portion 26 to move upward an equal distance. This will ensure that the wires will be maintained in electrical engagement over time, even when exposed to harsh environments.

Figure 4:
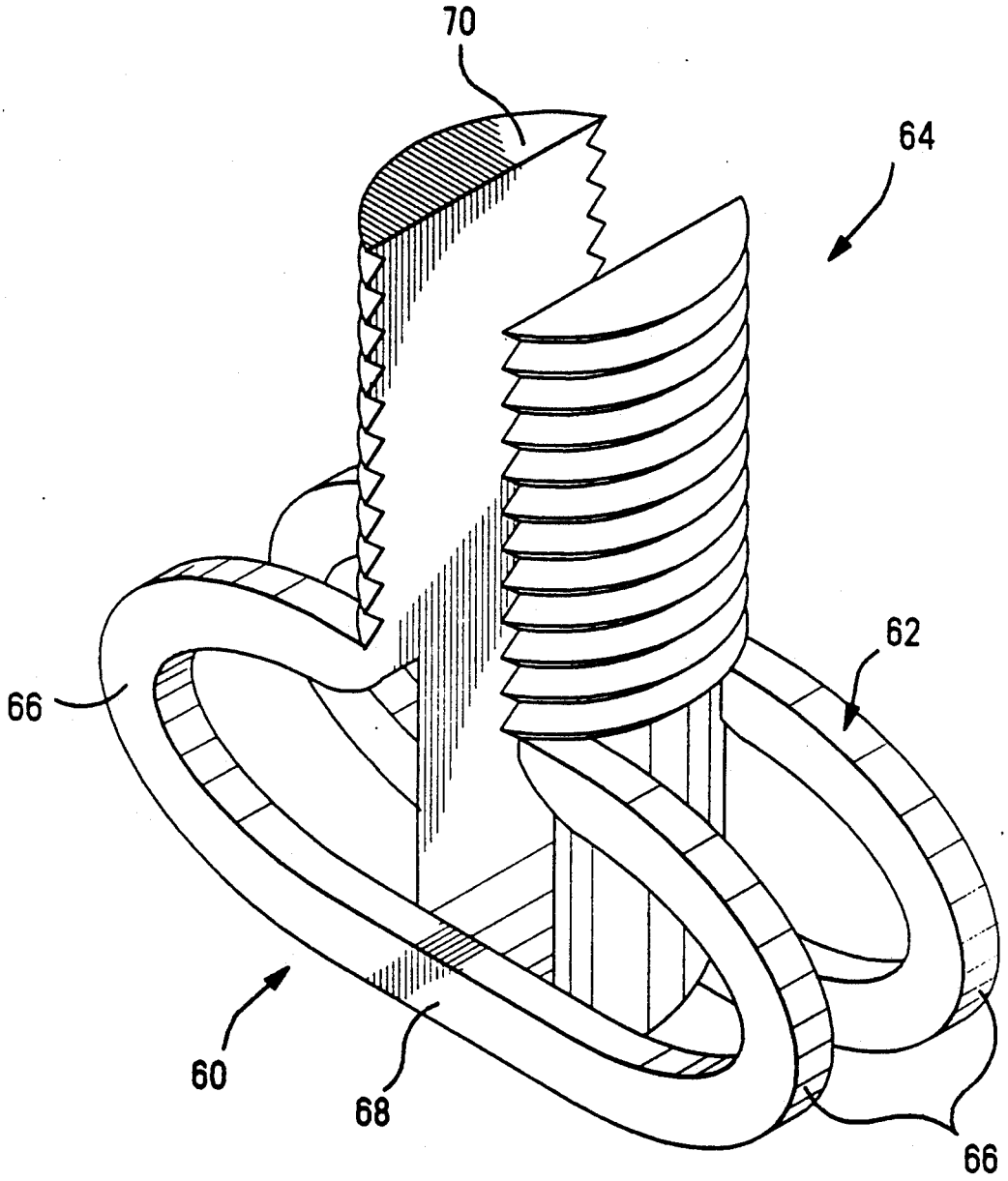
FIG. 4 is an isometric view of an alternate connector of the present invention.
Figure 5:
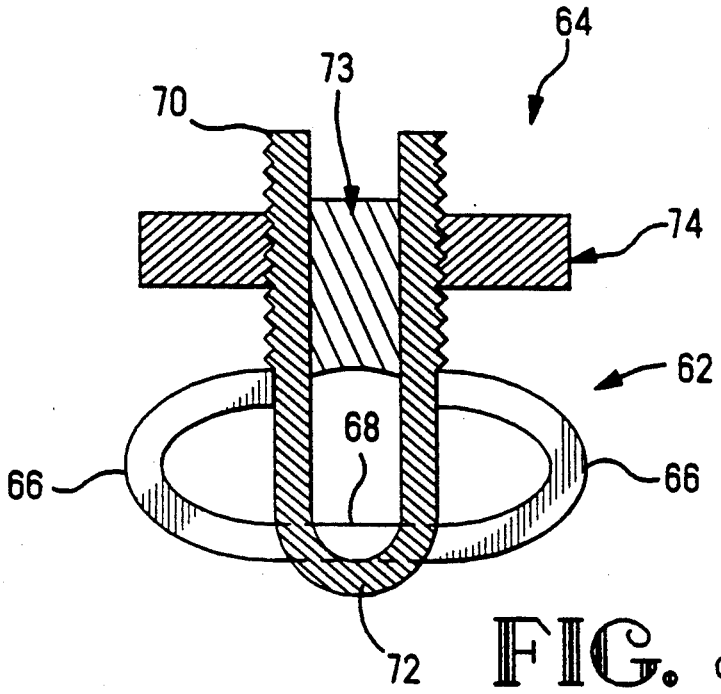
FIG. 5 is an elevational cross-sectional view of the alternate connector prior to the nut being installed onto the bolt.
Figure 6:
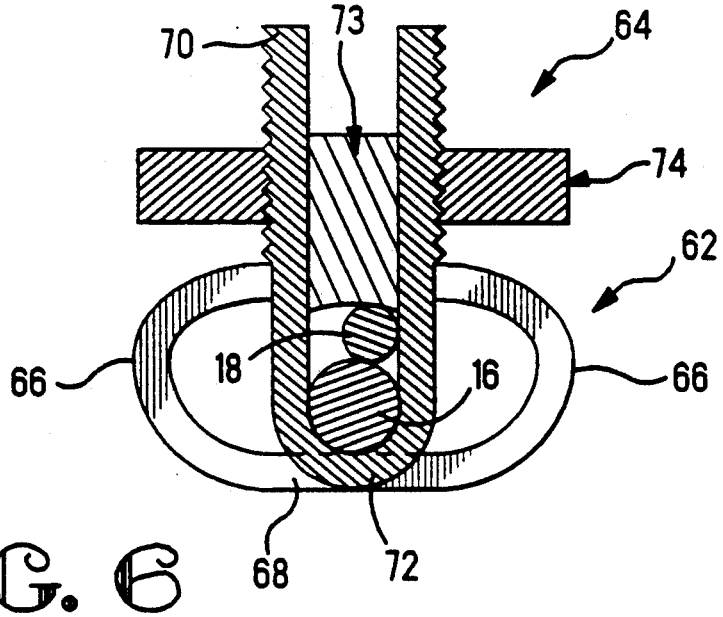
FIG. 6 is an elevational cross-sectional view, similar to that of FIG. 5, showing the alternate connector with the nut inserted on the bolt and the wires terminated thereto.

An alternate embodiment of the invention is shown in FIGS. 4 through 6. Resilient portions 60, 62 extend from the sides of split bolt 64. Each resilient portion 60, 62 has two arcuate sections 66 and a wire engagement section 68. The wire engagement section 68 extends between the arcuate sections 66.

In the initial position, as shown in FIG. 5, the engagement sections 68 are provided between free ends 70 of the split bolt 64 and fixed end 72. However, as the nut 74 and slide 73 are moved toward the fixed end 72, the slide 73 is forced into engagement with the wires, which in turn forces the wires into engagement with the sections 68. The continued advancement of the nut and slide causes the wires to deform the engagement sections 68 to the position shown in FIG. 6. In this final position, the bottom of the wire engages the fixed end 72 and the engagement sections 68 of the split bolt 64.

As was described relative to the first embodiment, the movement of the engagement sections 68 causes the arcuate sections 66 to be resiliently deformed to a stressed position. In this stressed position, the arcuate sections 66 will exert a force on the engagement sections 68. This force will cause the engagement sections 68 to resist the downward movement thereof. Consequently, if the nut is caused to move upward, away from the wires, the resilient force will cause the engagement sections 68 to move upward an equal distance. This ensures that the wires will be maintained in electrical engagement over time.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

I claim:

1. An electrical wire connector of the type having a bifurcate bolt having opposed prongs spaced apart to define a wire receiving channel therebetween, a nut threadable onto the bolt about the prongs, and a slide adjacent the nut, the slide engages a first respective wire to urge the first wire and at least one other wire into electrical engagement, the connector comprising:

resilient portions integral with and extending from the prongs, the resilient portions have an engagement portion which extends therebetween, the resilient portions are resiliently deformed when the nut is tightened, such that the resilient portions will cooperate with the engagement portion to supply a force to the wires, the force is sufficient to ensure that the wires will be maintained in electrical engagement between the slide and the engagement portion;

the engagement portion extends in a direction which is essentially perpendicular to the longitudinal axis of the prongs, the engagement portion has an enlarged section positioned thereon, a free end of the enlarged section has an arcuate configuration which cooperates with the wires.

2. An electrical connector as recited in claim 1 wherein the resilient portions having an arcuate configuration.

3. An electrical connector as recited in claim 1 wherein the prongs have free ends and fixed ends, the resilient portions are integrally attached to the prongs proximate the fixed ends.

4. An electrical connector as recited in claim 1 wherein a second respective wire is retained in the wire receiving channel by the cooperation of the resilient portions and the free end of the enlarged section of the bottom portion.

5. An electrical connector as recited in claim 2 wherein the resilient portions extend from fixed ends of the prongs to respective ends of the engagement portion.

6. An electrical connector as recited in claim 2 wherein the resilient portions extend from the prongs at a position between a fixed end and free ends thereof.

7. An electrical connector as recited in claim 6 wherein the engagement portion is positioned between the free ends and the fixed end of the prongs in the initial position.

8. An electrical connector as recited in claim 7 wherein the engagement portion is positioned proximate the fixed end of the prongs when the nut has been fully tightened.

9. An electrical connector as recited in claim 1 wherein the engagement portions are deformable between a first position and a second position as the two wires are urged into electrical engagement.

10. A split bolt which cooperates with a nut, a slide, and at least two wires to provide an electrical connection between the wires, the split bolt comprising;

a resilient member having an engagement portion and resilient portions, the resilient portions each have an essentially C-shaped configuration;

two opposed spaced apart prongs which have free ends and fixed ends, the prongs are integrally attached to the resilient portions;

a wire receiving channel extending between the prongs;

whereby the resilient portions are resiliently deformed between a first position and a second position when the nut is tightened and the slide forces the wire toward the engagement portion, such that the resilient portions will cooperate with the engagement portion to supply a force to the wires, the force is sufficient to ensure that the wires will be maintained in electrical engagement between the slide and the engagement portion.

11. A split bolt as recited in claim 10 wherein the engagement portion has an enlarged section with an arcuate surface provided at a free end thereof, the arcuate surface defines the end of the wire receiving channel.

12. A split bolt as recited in claim 10 wherein the resilient portions extend from the prongs at a position between the fixed ends and the free ends.

13. A split bolt as recited in claim 12 wherein the engagement portion extends between and is integrally attached to the resilient portions.

14. A split bolt as recited in claim 12 wherein the engagement portions are deformable between a first position and a second position as the two wire are urged into electrical engagement.

15. A split bolt which cooperates with a nut and at least two wires to provide an electrical connection between the wires, the nut being movable between a first position and a second position, the split bolt comprising:

a resilient member having an engagement portion and resilient portions, the resilient portions extend from ends of the engagement portion, the resilient portions are essentially C-shaped and are provided in an unstressed position when the nut is in the first position and a stressed position when the nut is in the second position;

two opposed spaced apart prongs extending from the resilient portions, the prongs having fixed ends which are integrally attached to the resilient portions and oppositely facing free ends, a wire receiving channel extending between the prongs;

whereby the resilient portions are resiliently deformed when the nut is moved from the first position to the second position, such that the resilient portions will cooperate with the engagement portion to supply a force to the wires, the force is sufficient to ensure that the wires will be maintained in electrical engagement.

16. A split bolt as recited in claim 15 wherein the engagement portion has an enlarged section with an arcuate surface provided at a free end thereof, the arcuate surface defines the end of the wire receiving channel.

17. A split bolt which cooperates with a nut assembly and at least two wires to provide an electrical connection between the wires, the split bolt comprising;

a resilient member having an engagement portion and resilient portions;

two opposed spaced apart prongs which have free ends and fixed ends, the prongs are integrally attached to the resilient portions;

a wire receiving channel extending between the prongs;

the resilient portions are configured to have a greater length than the length of the distance provided between the engagement portion and the fixed ends of the prongs;

whereby the resilient portions are resiliently deformed when the nut assembly is tightened, such that the resilient portions will cooperate with the engagement portion to supply a force to the wires, the force is sufficient to ensure that the wires will be maintained in electrical engagement between the nut assembly and the engagement portion.

* * * * *